United States Patent [19]

Crawford et al.

[11] Patent Number: 4,899,397

[45] Date of Patent: Feb. 13, 1990

[54] ASPIRATOR FOR A TUB/SHOWER DIVERTER ASSEMBLY

[75] Inventors: Dennis W. Crawford, Pontiac; Larry G. Turner, Fenton, both of Mich.

[73] Assignee: Masco Corporation of Indiana, Taylor, Mich.

[21] Appl. No.: 175,080

[22] Filed: Mar. 30, 1988

[51] Int. Cl.[4] ..... E03C 1/00

[52] U.S. Cl. ..... 4/191; 4/192; 251/127

[58] Field of Search ..... 4/191, 192; 251/127

[56] References Cited

U.S. PATENT DOCUMENTS

| | | | |
|---|---|---|---|
| 943,458 | 12/1909 | Podmore | 4/191 |
| 1,212,806 | 1/1917 | Newton | 4/192 |
| 1,530,104 | 3/1925 | Brown | 4/191 |
| 1,666,531 | 4/1928 | Glauber | 4/191 |
| 2,348,238 | 5/1944 | Beeke et al. | 4/192 |
| 2,848,721 | 8/1958 | Fredrickson | 4/192 |
| 3,012,251 | 12/1961 | Fife | 4/192 |
| 3,080,570 | 3/1963 | Weddendorf, Jr. | 4/192 |
| 3,471,872 | 10/1969 | Symmons | 4/191 |

FOREIGN PATENT DOCUMENTS

| | | | |
|---|---|---|---|
| 74618 | 8/1952 | Denmark | 4/192 |
| 2750140 | 5/1979 | Fed. Rep. of Germany | 4/192 |
| 2941940 | 4/1981 | Fed. Rep. of Germany | 4/192 |
| 80780 | 4/1934 | Sweden | 4/192 |

*Primary Examiner*—Stephen Marcus
*Assistant Examiner*—Christine A. Peterson
*Attorney, Agent, or Firm*—Steven L. Permut; Malcolm L. Sutherland

[57] ABSTRACT

A two piece aspirator is constructed to be fitted within a fitting such that an annular clearance is provided between the bore that has two supply inlets and a depending cylindrical section of the aspirator body. A venturi cap member is snap fitted onto the aspirator body and has an outer periphery axially spaced from the end of the cylindrical section to provide an annular opening thereabout which is in communication with a passage through the aspirator body. The venturi or cap has a radial section which spans most of the interior of the cylindrical section and has a frusto-conical section which is complementary to a tapered end of the cylindrical section to provide for a radially extending section of the passageway leading to the annular opening. The passage of water through the annular clearance passing by the annular opening provides a venturi effect and therefore negative pressure resulting in air being sucked through the shower riser when water flows through the tub spout downstream of the fitting and through the passage and annular opening.

14 Claims, 2 Drawing Sheets

ASPIRATOR FOR A TUB/SHOWER DIVERTER ASSEMBLY

TECHNICAL FIELD

This invention is directed to a tub/shower diverter assembly and more particularly to an aspirator for a tub/shower diverter assembly.

BACKGROUND OF THE INVENTION

It has long been common for a bathtub alcove to have both a tub spout and a shower head. The shower head and spout commonly are both connected to the same single handle valve or set of hot and cold water valves. Furthermore, it is common to have a diverter valve mounted directly on the tub spout so that in one position water is allowed to exit through the tub spout and in the other position the diverter valve closes off the exit through the tub spout and forces water up through the shower riser to the shower head.

One of the common problems with such an arrangement between the shower head and tub spout is that there is no positive shut off to the shower head. Even when the diverter valve is positioned to direct water through the tub spout, sufficient pressure can build up within the shower riser leading to the shower head so water leaks through the shower head.

Previous attempts to prevent the leakage through the shower head have required an aspirator insert which was threaded into a bore of a fitting. One aspirator has side inlets so that a counterbore within the fitting is needed to receive water from the inlet port to pass about the aspirator to the side inlets. The water is then directed through a passage having a 90 degree turn and is jetted out through a downward facing exit into the tub spout pipe.

Another aspirator attempting to eliminate the leakage through the shower head has an extended restricting tubular section depending from a threaded head section. The tubular section extends downwardly more than an inch or so to provide a fluid restriction upward therethrough so that pressure needed to force the water upward through the narrow tubular passage and up through the shower riser is greater than the water pressure exerted through the water pipe to eliminate the leakage through the shower head.

However, these attempts have not been uniformly successful and water leakage can still occur particularly if the water valves are fully opened.

Another problem occurs with turbulence created by the aspirator insert and fitting resulting in noise being transmitted through the pipes in the wall causing reverberation or noise within the confines of the tub alcove.

What is needed is a tub/shower aspirator that will both eliminate leakage through the shower head when water is directed through the tub spout and furthermore reduce noise caused by the flow of water from the water valves through the pipe fitting housing the aspirator.

SUMMARY OF THE INVENTION

In accordance with one aspect of the invention, a tub/shower diverter aspirator has a tubular body with an upper end having fastening means for fastening the body to a pipe fitting. The lower end of the aspirator has an annular opening therethrough. A passage means is in fluid communication with the annular opening and axially extends through the tubular body to the upper end.

The fastening means is preferably a threaded section at the outer periphery of an enlarged upper end of the tubular body which engages internal threads in the bore of the fitting. The fastening means also sealingly fixes the aspirator to the fitting such that water does not pass by the outer periphery of the enlarged upper end of the tubular body. The annular opening is preferably continuous about the perimeter of the tubular body and has a substantially vertical extent.

When the aspirator is threaded into an appropriate fitting, water passes through an annular clearance between the fitting bore wall and the tubular body and across the annular opening such that a negative pressure occurs to draw air from the shower head and through the shower riser to the fitting and through the passage end annular inlet to the water flow when water passes through the tub spout.

In accordance with another aspect of the invention, the tub/shower diverter aspirator is characterized by a body member having a first end constructed to be sealingly fitted in a pipe fitting with the body member having a depending tubular section with a passage therethrough. A deflector member is attached to the body member with the deflector member having an outer perimeter axially spaced from the end of the tubular member to define an annular inlet between the deflector member and the body member. The deflector member has a solid radially extending surface. The outer perimeter preferably has a diameter slightly less than the diameter of the tubular member.

In accordance with another aspect of the invention, a venturi deflector member is attached to a tub/shower aspirator body member wherein the venturi deflector member has a radially extending surface ending at the outer periphery thereof. An attachment device on the radially extending surface connects the venturi deflector member to the aspirator body. The outer periphery of the venturi deflector member is positioned from the attachment means such that when the attachment means attaches the venturi deflector member to the aspirator body the outer periphery is spaced from the body to form an annular opening adjacent an edge of the outer periphery. Preferably the radially extending surface has a frusto-conical section which extends to the upper edge of the outer periphery.

In accordance with another aspect of the invention, the tub/shower diverter aspirator has a top end sealingly and fixedly attached to an internal wall of a bore in a fitting. A cylindrical body depends from the top end and has an outer radius sized such that an outer restricting annular space is formed between the bore wall of the fitting and the cylindrical body. The annular space has a cross-sectional area which is less than the cross-sectional area of the spout opening or the cross-sectional area of the port inlets of the fitting.

The cylindrical body is positioned so that it is laterally positioned next to the side inlets. An inner venturi deflector section is positioned radially within the cylindrical body forming an annular inlet between the venturi deflector section and the cylindrical body. The annular inlet passage extends upward through the cylindrical body through the top end.

Preferably the deflector section has a flared bottom end extending axially below a bottom end of the cylindrical body and the flare bottom end has an outer diameter less than the outer diameter of the cylindrical body.

Preferably the annular passage is continuous about the circumference of the cylindrical body and uninterrupted by any ribs or supporting members between the deflector section and cylindrical body.

It is desirable that the deflector section in a separate member be attached to an inner cylindrical section of the aspirator body. The inner cylindrical section is attached to the enlarged upper end of the outer cylindrical body.

An aspirator of this construction provides for an annular passage of flow about the cylindrical body. A venturi effect provides for suction of air through the passage and out through the annular opening caused by the stream exiting the narrow annular clearance between the fitting and outer cylindrical body downstream to an open lower bore section of the fitting. The annular opening into the aspirator is positioned at the transition to the lower bore section.

The venturi effect through the annular opening provides for elimination of any leakage of water through the shower head when the water is directed through the tub spout and further provides for a smoother less turbulent flow which reduces noise.

BRIEF DESCRIPTION OF THE DRAWINGS

Reference now will be made to the accompanying drawings in which.

DETAILED DESCRIPTION OF THE PREFERRED EMBODIMENT

Figure 1:
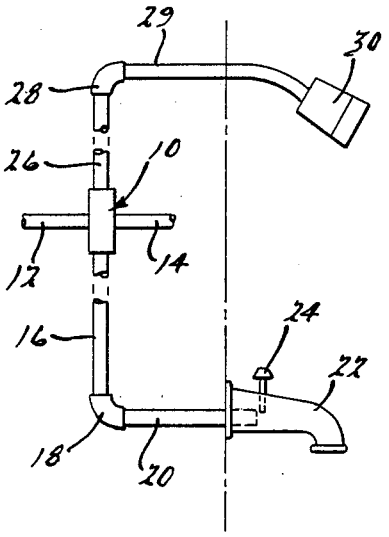
FIG. 1 is a schematic view of a tub spout and shower head assembly incorporating a fitting that includes an aspirator in accordance with the invention.

Referring now to FIG. 1, a fitting 10 is connected to hot and cold water supply pipes 12 and 14. Respective hot and cold valves are not shown for simplicity of the drawing. The fitting 10 is also connected to a tub spout delivery pipe 16 extending downwardly to an elbow fitting 18 that connects to a pipe nipple 20 that mounts a tub spout 22. The tub spout 22 has a diverter valve 24 mounted therein. The fitting 10 is also connected to a shower riser 26 which, through an elbow 28 and shower arm 29, is connected to a shower head 30.

Figure 3:
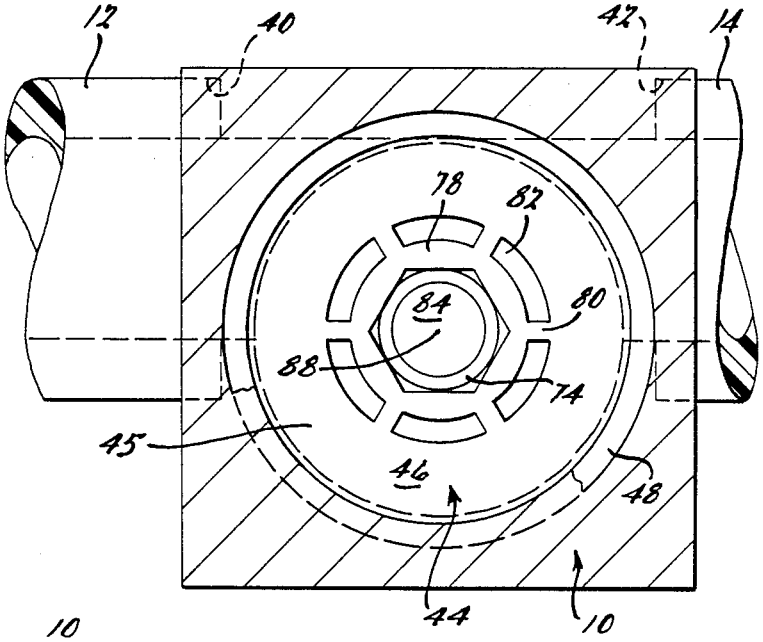
FIG. 3 is a cross-sectional view taken along the lines 3—3 of FIG. 2.
Figure 4:
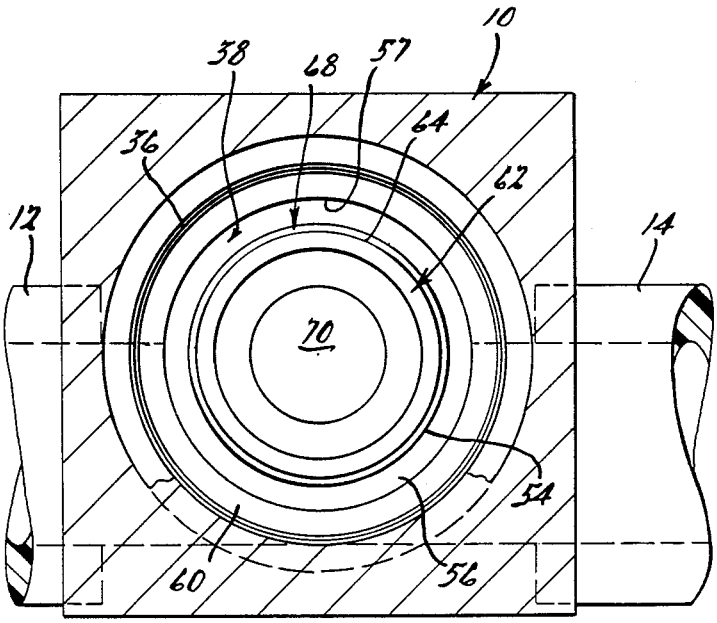
FIG. 4 is a cross-sectional view taken along the line 4—4 of FIG. 2.
Figure 2:
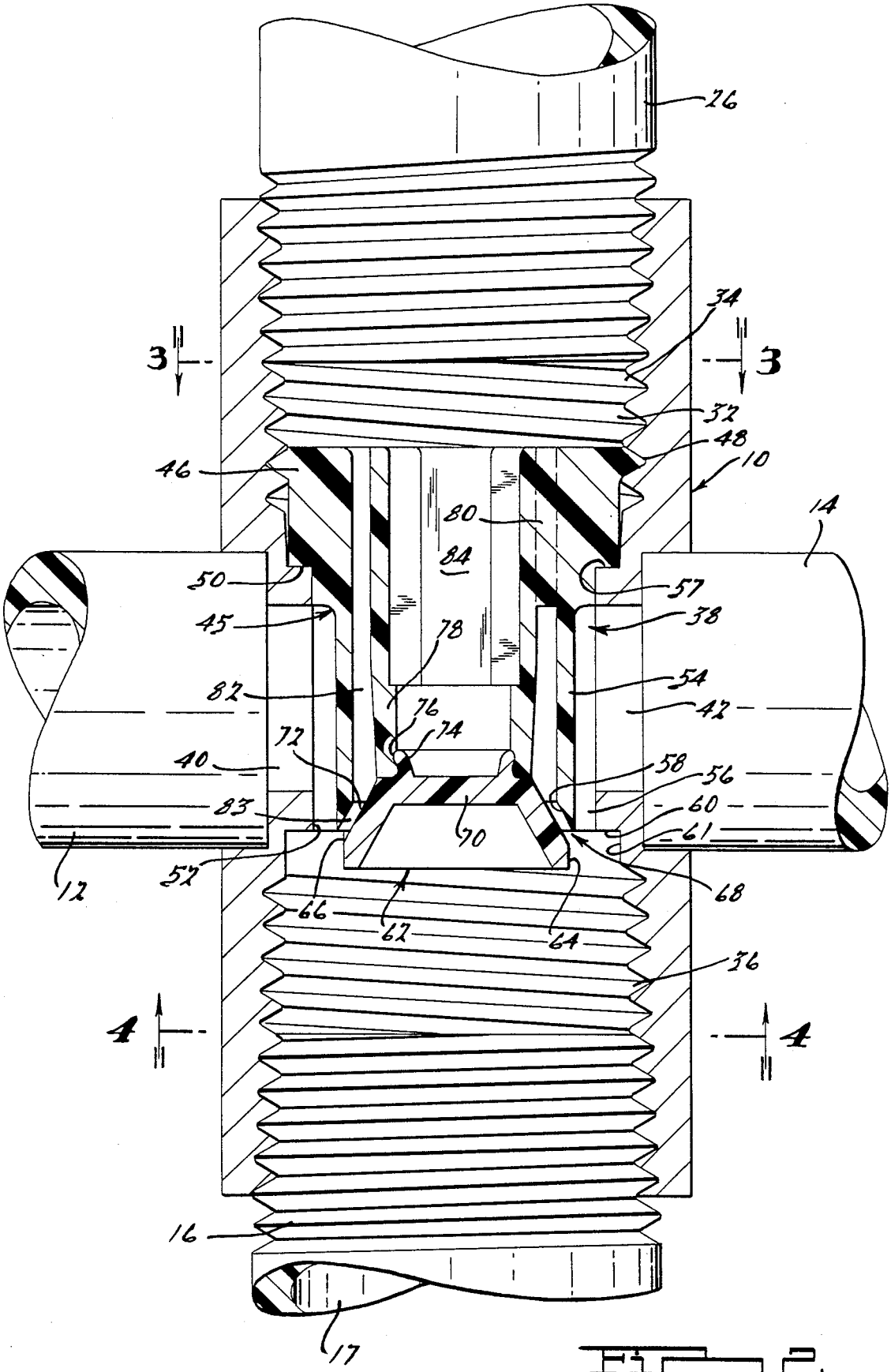
FIG. 2 is an enlarged, cross-sectional view of the fitting shown in FIG. 1 showing an aspirator in accordance with the invention.

As shown in more detail in FIGS. 2–4, fitting 10 has a substantially vertical bore 32 with upper and lower threaded sections (or outlets) 34 and 36 which threadably engage the shower riser 26 and tub spout delivery pipe 16, respectively. The vertical bore has a narrow mid-section 38 with side inlet ports 40 and 42 in communication with supply pipes 12 and 14.

A two piece aspirator 44 has an aspirator body 45 and venturi deflector member 62 or venturi cap. The aspirator body 45 has an enlarged upper end 46 that has a thread 48 engaging the threaded section 34 of bore 32. The enlarged upper end has a shoulder section 50 which sealingly engages the shoulder wall 57 of the mid-section 38 of bore 32. An outer cylindrical or tubular section 54 depends from the enlarged end 46 and has an outer diameter sized to create an annular clearance 56 with the wall 52 of bore section 38. The cylindrical section 54 has an internal tapered end 58 that is positioned with radially outwardly extending shoulder 60 at the transition between lower end of bore section 38 and wider threaded section 36.

The venturi cap or deflector member 62 has an outer periphery 64 with a diameter slightly smaller than the outer diameter of cylindrical section 54. The upper edge 66 of the outer periphery 64 is positioned below the tapered end 58 of the cylindrical section 54 to create an annular opening 68 with a basically vertical orientation. The deflector member 62 has a radially expanding section 70 which extends radially inwardly from the outer periphery 64. Part of the radially extending section 70 has a frusto-conical surface 72 which corresponds to the tapered end 58. The deflector member 62 is attached to the aspirator body 45 via an integral snap ring 74 at the top of the section 70 and centrally positioned which snaps into complementary annular groove 76 in an inner cylindrical section 78 of the body member 45. The inner cylindrical section 78 is connected via a series of ribs 80 to the enlarged upper end 46. The inner cylindrical section 78 is spaced from the outer cylindrical section 54 to create a passage 82 which extends through the upper end 46 between the ribs 80. The annular opening 68 is in fluid communication with the axially extending passage 82. The axially extending passage has a radially outward turn 83 provided by the tapered end 58 and frusto-conical surface 72. The coring space 84 within the inner cylindrical section 78 does not provide a passage because the radially extending section 70 closes it off when it is snapped in position. The coring space 84 can be hexagonally shaped at its upper end to receive an Allen wrench for rotatably threading the body 45 into the threaded section 34.

As shown in FIG. 3, the ribs 80 are circumferentially spaced about the axial center 88 of the aspirator and connects the inner cylindrical section 78 to the enlarged upper end 46 of the aspirator body 45. The two inlet ports are offset to the rear portion of the fitting 10. As shown in FIG. 4 the outer periphery 64 of the venturi deflector cap member 62 has a diameter slightly smaller than the outer diameter of the cylindrical section 54. Preferably, the deflector member has an outer diameter of approximately 0.47 inches while the cylindrical section has an outer diameter of 0.50 inches to render the diameter smaller by approximately 0.03 inches.

The diameter of the mid section 38 is approximately 0.60 inches so that the annular space has a width of approximately 0.05 inches.

The cross-sectional area of the annular clearance 56 is smaller than the internal area 17 of pipe 16 or the cross-sectional area through the spout 22 to minimize pressure back up as water flows through the annular clearance.

In operation, when water is turned on and flows through either or both of pipes 12 and 14, the water enters either or both of ports 40 and 42 and passes through annular clearance 56. The flow is forced by the limited cross-sectional area of annular clearance 56 to an increased velocity. The rapid flow laterally passes by the annular opening 68 and flows into the lower threaded section 36 and pipe 16. The shoulder wall 61 and the outer periphery 64 are spaced to provide an increased width compared to annular clearance 56 such that a pressure drop occurs so that air is sucked through passage 82 and through the annular opening 68 as water flows through the spout 22. The air is obtained through the shower head 30 that passes through the arm 29, elbow 28, riser 26 and through passage 82.

When a shower is desired, the diverter 24 is placed in the closed position and water then backs up through the annular opening 68, through passage 82, up through shower riser 26 and passes through shower head 30.

The construction of the aspirator eliminates unwanted leakage through the shower head 30 and also provides for reduced noise levels. The aspirator is made by molding two separate pieces of plastic into the aspirator body 45 and venturi deflector member 62 and snap fitting them together. The hexagonal shaped core 84 provides for a simple drive mechanism to which the aspirator can be screwed into the taper threaded section 34 of the fitting 10. The tapered threaded section prevents the pipe 26 from being screwed down far enough to touch and crush the aspirator. The cylindrical section 54 is sized so that counterboring of the mid section 38 is eliminated and is needed with other types of aspirators. Furthermore, the annular shape of clearance 56 provides the clearance to be adjacent both ports 40 and 42 and provides for a less turbulent flow which then provides for a more laminer flow passing the annular opening 68 at high speed resulting in a venturi effect that eliminates a pressure rise in the shower riser. The aspirator in fact provides for a negative pressure which allows air to be sucked through the shower head 30 as the water flows through the spout 22.

Variations and modifications of the present invention are possible without departing from the scope and spirit as defined in the appended claims.

The embodiments of the invention in which an exclusive property or privilege is claimed are defined as follows:

1. A tub/shower diverter aspirator for being positioned in a fitting having a vertical bore with a lower outlet and upper outlet and at least one side inlet, said aspirator characterized by:

an upper end sealingly and fixedly attached to an internal wall of the bore between said lower and upper outlets;

a cylindrical body depending from said top end and having an outer radius sized such that an outer restricting annular space is formed between the bore and the cylindrical body and in open communication with said lower outlet; said cylindrical body being positioned laterally from said at least one side inlet and extending below said side inlet;

a fixed inner deflector means fixed radially within said cylindrical body for forming an annular passage between the body and said deflector means fluidly communicating said lower outlet to said upper outlet.

2. A tub/shower aspirator as defined in claim 1 further characterized by:

said deflector means having a flared bottom end extending axially below a bottom end of the cylindrical body.

3. A tub/shower diverter apparatus as defined in claim 2 further characterized by:

said flared bottom end having a radius less than said outer radius of said cylindrical body.

4. A tub/shower diverter aspirator for being positioned in a fitting having a straight bore therethrough, with a lower outlet and upper outlet of the bore in fluid communication with a shower head, said lower outlet of the bore in fluid communication with a tub spout, said fitting having at least one side inlet; said aspirator characterized by:

a cylindrical section extending in said bore laterally spaced from said at least one side inlet and extending below said side inlet; said cylindrical section having an outer radius sized such that an annular clearance is formed between said cylindrical section and an inner wall of said bore with said annular clearance having a cross-sectional area smaller than the cross-sectional area of said at least one side inlet, said annular clearance having a first sealed end and a second open end;

a sealing means for sealing said first end of said annular clearance above said at least one side inlet, a second end of said annular clearance being in open communication to said bore below said at least one side inlet and said lower outlet;

a passage means having one end adjacent the second end of said annular clearance, said passage means extending through the interior of said cylindrical section and past the sealing means and fluidly in open communication with said upper outlet such that a negative pressure is exerted on said one end of said passage means created by fluid flow through said annular clearance to said lower outlet; and said one end of the passage means having a radial outwardly deflector section toward said annular clearance and axially facing said passage means.

5. A tub/shower diverter aspirator as defined in claim 4 further characterized by:

said one end of the passage means being generally annular in shape.

6. A tub/shower diverter aspirator for being positioned in a fitting having a straight bore therethrough, a side inlet, a first end of the bore defining an upper outlet in communication with a shower head and a second end of the bore defining a lower outlet in communication with a tub spout, said aspirator characterized by:

a first passage means having a cross-sectional area smaller than said inlet to its first end such that its forming a venturi therethrough to its second end;

a sealing means sealing said passage from said first end of said bore;

a second passage having a radially extending first end laterally in communication with the first passage;

said second passage extending through said sealing means to be in open communication with the first end of the bore.

7. A tub/shower diverter aspirator for being fitted in a fitting having an upper outlet being in fluid communication with a shower head and a lower outlet being in fluid communication with a tub spout; said aspirator characterized by:

a tubular body having an upper end with a fastening means for fastening said body to said fitting;

said tubular body having a lower end section with an annular opening therethrough;

a passage means in communication with said annular opening and axially extending through said tubular body to said upper end such that it is in open communication with said upper outlet.

8. An aspirator as defined in claim 7 further characterized by:

said annular opening having a substantially vertical extent and circumscribing an outer surface of said tubular body.

9. An aspirator as defined in claim 8 further characterized by:

said annular opening being continuous about said perimeter of said tubular body.

10. A tub/shower diverter aspirator characterized by:

a tubular body having a radially enlarged upper end having threaded means constructed for sealingly fastening said body to a threaded bore in a fitting;

said tubular body having an outer depending cylindrical section having an internally tapered end;

said tubular body having a fixed inner depending cylindrical section coaxially mounted with said outer cylindrical section to form an annular space therebetween;

a venturi cap member having a means for fixedly connecting to said inner depending cylindrical section;

the inner depending cylindrical section having an end constructed to be fastened to said venturi cap member;

said venturi cap member having a frusto-conical surface extending radially outward to a cylindrical surface having a diameter slightly less than an outer diameter of said outer depending cylindrical section;

the tapered end of said outer depending cylindrical section being axially spaced from said cylindrical surface of said venturi cap to form a substantially vertically extending annular opening in communication with said annular space, said annular opening being free from any obstructing support rib extending between said outer depending cylindrical section and said venturi cap.

11. A two piece tub/shower diverter aspirator characterized by:

a body member having a first end constructed to be sealingly fitted in a pipe fitting;

said body member having a fixed depending tubular section with a passage axially passing therethrough;

an attachment means radially within said tubular section for fixedly attaching a deflector member thereto;

said deflector member having a corresponding attachment means for connection with said attachment means of said body member;

said deflector member having an outer perimeter axially spaced from an end of said tubular member to define an annular inlet between said deflector member and said body member, said annular inlet extending in an axial direction with respect to said body member and in fluid communication with said passage;

said deflector member having a solid radially extending surface inside said perimeter to direct substantially all flow through said annular member.

12. A venturi deflector member for a tub/shower diverter aspirator body characterized by:

a fixed radially extending surface ending at an outer periphery;

an attachment means on said radially extending surface to fixedly connect to a tub/shower diverter aspirator;

said outer periphery positioned from said attachment means such that when said attachment means attaches said venturi deflector member on a tub/shower diverter aspirator body, said outer periphery is spaced from said body to form an annular opening adjacent an edge of said outer periphery.

13. A venturi deflector member as defined in claim 12 further characterized by:

said radially extending surface having a frusto-conical section extending to said edge of said outer periphery.

14. A venturi deflector member as defined in claim 12 wherein said attachment means comprises a snap ring integrally formed with said radially extending surface and extending upwardly therefrom.

* * * * *